United States Patent [19]

Abe et al.

[11] Patent Number: 4,737,914

[45] Date of Patent: Apr. 12, 1988

[54] LEARNING CONTROL SYSTEM FOR CONTROLLING AN AUTOMOTIVE ENGINE

[75] Inventors: Kunihiro Abe; Yoshitake Matsumura; Takurou Morozumi, all of Tokyo, Japan

[73] Assignee: Fuji Jukogyo Kabushiki Kaisha, Tokyo, Japan

[21] Appl. No.: 757,821

[22] Filed: Jul. 22, 1985

[30] Foreign Application Priority Data

Jul. 27, 1984 [JP] Japan ..... 59-158032

[51] Int. Cl.[4] ..... F02M 17/00

[52] U.S. Cl. ..... 364/431.04; 364/431.05; 364/431.12; 123/486; 123/489

[58] Field of Search ..... 364/431.04, 431.05, 364/431.12; 123/486, 480, 489, 440

[56] References Cited

U.S. PATENT DOCUMENTS

| | | | |
|---|---|---|---|
| 4,235,204 | 11/1980 | Rice | 123/480 |
| 4,376,428 | 3/1983 | Hata et al. | 364/431.04 |
| 4,517,948 | 5/1985 | Kaji et al. | 123/489 |
| 4,530,333 | 7/1985 | Nishimura | 123/489 |
| 4,546,747 | 10/1985 | Kobayashi et al. | 123/489 |
| 4,566,068 | 1/1986 | Iwasaki et al. | 123/486 |

*Primary Examiner*—Parshotam S. Lall

*Attorney, Agent, or Firm*—Martin A. Farber

[57] ABSTRACT

Steady state of engine operating conditions is determined by two variables of engine operation. A table is provided comprising a two-dimensional table having addresses dependent on one of the two variables and a three-dimensional table having addresses dependent on the two variables is provided. Data stored in the two-dimensional and three-dimensional tables are updated with new data obtained at the determined steady state at a corresponding address.

8 Claims, 6 Drawing Sheets

FIG. 3a
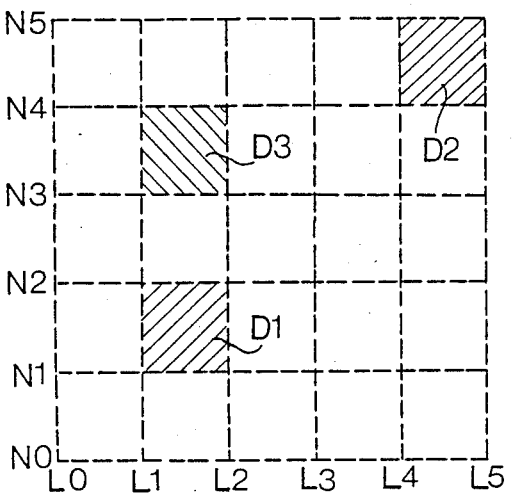
FIG. 3b
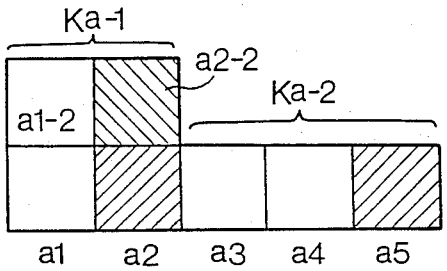
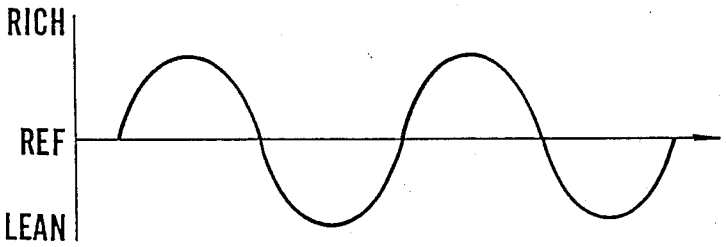
FIG. 4a
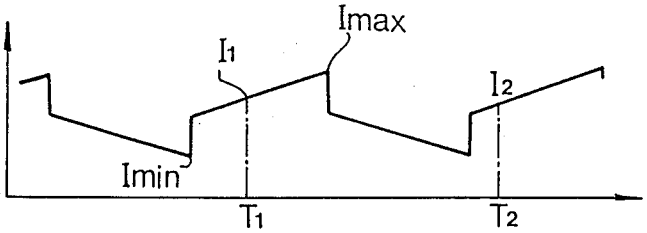
FIG. 4b

LEARNING CONTROL SYSTEM FOR CONTROLLING AN AUTOMOTIVE ENGINE

BACKGROUND OF THE INVENTION

The present invention relates to a system for controlling the operation of an automotive engine, and more particularly to a learning control system for updating data stored in a table for the learning control. In the learning control syste, the updating of data is performed with new data obtained during the steady state of engine operation. Accordingly, means for determining whether the engine operation is in steady state is necessary. A conventional learning control system has a matrix (two-dimensional lattice) comprising a plurality of divisions, each representing engine operating variables such as engine speed and engine load. When the variables continue for a predetermined period of time in one of the divisions, it is determined that the engine is in steady state. On the other hand, a three-dimensional look-up table is provided, in which a matrix coincides with the matrix for determining steady state. For such a three-dimensional table, a RAM having a large capacity must be provided.

In order to reduce the capacity of the RAM, in a fuel injection control system, a two-dimensional look-up table dependent on one of variables, such as engine load, is provided regardless of engine speed. However, at low engine load under particular conditons such as a traffic jam, the air-fuel ratio of the air-fuel mixture should be controlled taking also engine speed into consideration in order to provide a proper air-fuel ratio.

SUMMARY OF THE INVENTION

Accordingly, the object of the present invention is to provide a system which may control an engine operation with data stored in a RAM having a small capacity without reducing the operability of the engine under particular engine operating conditions.

According to the present invention there is provided a system for controlling an automotive engine by updated data, comprising: first means for determining that engine operation is in steady state in accordance with two variables of engine operation and for producing an output signal, and second means for providing new data for updating in accordance with engine operating conditions. A table including a two-dimensional table having addresses dependent on one of the two variables is provided for storing data necessary for the learning control of the engine. A part of the table corresponding to particular engine operating conditions is composed of a three-dimensional table having the Y axis of the other variable. The data stored in the two-dimensional table is updated with the new data in response to the output signal of the first means at a corresponding address.

In an aspect of the present invention, the system further comprises fourth means for detecting one of the engine operating conditions and for producing a feedback signal dependent on the condition, and the new data for updating is the feedback signal.

The other objects and features of this invention will become understood from the following description with reference to the accompanying drawings.

BRIEF DESCRIPTION OF DRAWINGS

FIG. 3*a* is an illustration showing a matrix for detecting the steady state of engine operation;

FIG. 3*b* shows a table for learning control coefficients;

FIG. 4*a* shows the output voltage of an $O_2$-sensor;

FIG. 4*b* shows the output voltage of an integrator;

DETAILED DESCRIPTION OF THE PREFERRED EMBODIMENT

Figure 1:
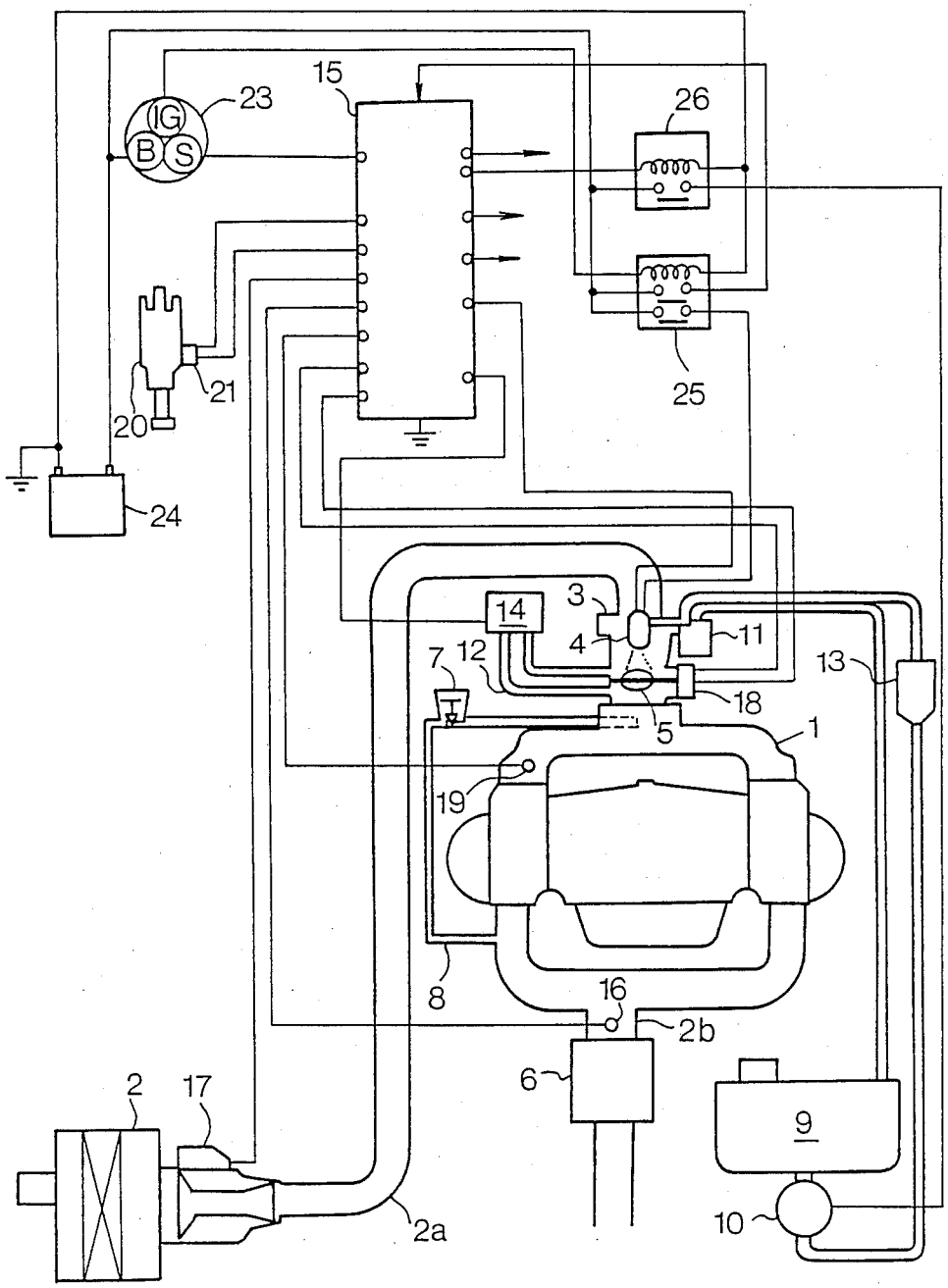
FIG. 1 is a schematic illustration showng a system for controlling the operation of an internal combustion engine for a motor vehicle.

Referring to FIG. 1, an internal combustion engine 1 for a motor vehicle is supplied with air through an air cleaner 2, intake pipe 2*a*, and throttle valve 5 in a throttle body 3, mixing with fuel injected from an injector 4. A three-way catalitic converter 6 and an $O_2$-sensor 16 are provided in an exhaust passage 2*b*. An exhaust gas recirculation (EGR) valve 7 is provided in an EGR passage 8 in a well known manner.

Fuel in a fuel tank 9 is supplied to the injector 4 by a fuel pump 10 through a filter 13 and pressure regulator 11. A solenoid operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn on-off electric current from a battery 24. The system is further provided with an injector relay 25 and a fuel pump relay 26 for operating the injector 4 and fuel pump 10.

Figure 2:
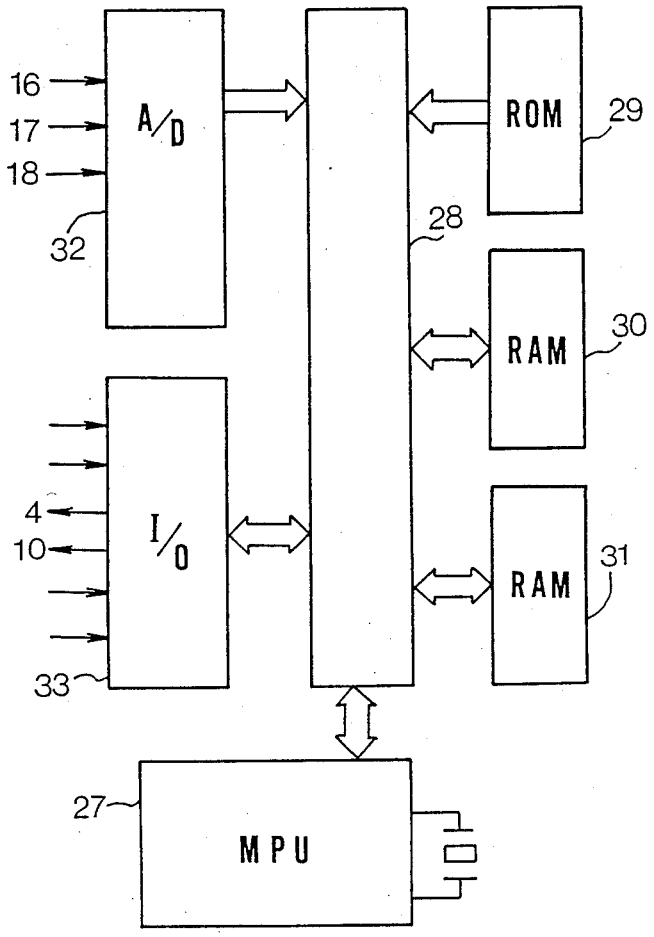
FIG. 2 is a block diagram of a microcomputer system used in a system of the present invention.

Referring to FIG. 2, the microcomputer 15 comprises a microprocessor unit 27, ROM 29, RAM 30, RAM 31 with back-up, A/D converter 32 and I/O interface 33. Output signals of $O_2$-sensor 16, mass flow meter 17 and throttle position sensor 18 are converted to digital signals and applied to the microprocessor unit 27 through a bus 28. Other signals are applied to the microprocessor unit 27 through I/O interface 33. The microprocessor manipulates input signals and executes hereinafter described process.

In the system, the amount of fuel to be injected by the injector 4 is determined in accordance with engine operating variables such as mass air flow, engine speed and engine load. The amount of fuel is decided by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (\text{COEF}) \times \alpha \times K_a \quad (2)$$

where COEF is a coefficient obtained by adding various correction or compensation coefficients such as coefficients on coolant temperature, full throttle open, engine load, etc., $\alpha$ is a $\lambda$ correcting coefficient (the integral of the feedback signal of the $O_2$-sensor 16) and $K_a$ is a correcting coefficient by learning (hereinafter called learning control coefficient). Coefficients, such as coolant temperature coefficient and engine load, are obtained by looking up tables in accordance with sensed informations.

The learning control coefficients $K_a$ stored in a $K_a$-table are updated with data calculated during the steady state of engine operation. In the system, the steady state is decided by engine operating conditions in predetermined ranges of engine load and engine speed and continuation of a detected state. FIG. 3*a* shows a matrix for the detection, which comprises, for example twenty-five divisions defined by six row lines and six column lines. Magnitudes of engine load are set at six points from light load $L_0$ heavy load $L_5$ on the X axis, and magnitudes of engine speed are set at six points from low speed $N_0$ to high speed $N_5$ on the Y axis. Thus, the engine load is divided into five ranges, that is $L_0$–$L_1$, $L_1$–$L_2$, $L_2$–$L_3$, $L_3$–$L_4$, and $L_4$–$L_5$. Similarly, the engine speed is divided into five ranges.

On the other hand, the output voltage of the $O_2$-sensor 16 cylically changes through a reference voltage corresponding to a stoichiometric air-fuel ratio, as shown in FIG. 4*a*. Namely, the voltage changes between high and low voltages corresponding to rich and lean air-fuel mixtures. In the system, when the output voltage (feedback signal) of the $O_2$-sensor continues during three cycles within one of twenty-five divisions in the matrix, the engine is assumed to be in steady state.

FIG. 3*b* shows a $K_a$-table for storing the learning control coefficients $K_a$, which is included in the RAM 31 of FIG. 2. The $K_a$-table comprises a three-dimensional table $K_a$-1 and a two dimensional table $K_a$-2. the table $K_a$-1 has addresses $a_1$, $a_2$,$a_1$-2 and $a_2$-2 and table $K_a$-2 has addresses $a_3$ to $a_5$. Addresses $a_1$ to $a_5$ correspond to engine load ranges $L_0$–$L_1$, $L_1$–$L_2$, $L_2$–$L_3$, $L_3$–$L_4$, and $L_4$–$L_5$, and addresses $a_1$ and $a_1$-2 correspond, for example to engine speed ranges $N_0$–$N_2$ and $N_2$–$N_5$. All of the coefficients $K_a$ stored in the $K_a$-table are initially set to the same value, that is the numerical value "1". This is caused by the fact that the fuel supply system is to be designed to provide the most proper amount of fuel without the coefficient $K_a$. However, every automobile can not be manufactured to have a desired function, resulting in same results. Accordingly, the coefficient $K_a$ should be updated by learning at every automobile, when it is actually used.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as value of correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, an integral of the output voltage of the $O_2$-sensor at a predetermined time is provided as the value of $\alpha$. More particularly, the computer has a function of an integrator, so that the output voltage of the $O_2$-sensor is integrated. FIG. 4*b* shows the output of the integrator. The system provides values of the integration at a predetermined interval (40 ms). For example, in FIG. 4*b*, integrals $I_1$, $I_2$—at times $T_1$, $T_2$—are provided. Accordingly, the amount of fuel is controlled in accordance with the feedback signal from the $O_2$-sensor, which is represented by integral.

Explaining the learning operation, when steady state of engine operation is detected in one of divisions of the matrix, data in a corresponding address of the $K_a$-table is updated with a value relative to the feedback signal from the $O_2$-sensor. When steady state is detected in a light load range $L_0$–$L_1$ or $L_1$–$L_2$, data in a corresponding address of the three-dimensional table $K_a$-1 is updated dependent on also the engine speed range $N_0$–$N_2$ or $N_2$–$N_5$. The first updating is done with an arithmetical average (A) of maximum value and minimum value in one cycle of the integration, for example values of Imax and Imin of FIG. 4*b*. Thereafter, when the value of $\alpha$ is not 1, the $K_a$-table is incremented or decremented with a minimum value ($\Delta$A) which can be obtained in the computer. Namely one bit is added to or subtracted from a BCD code representing the value A of the coefficient $K_a$ which has been rewritten at the first learning.

Figure 7A:
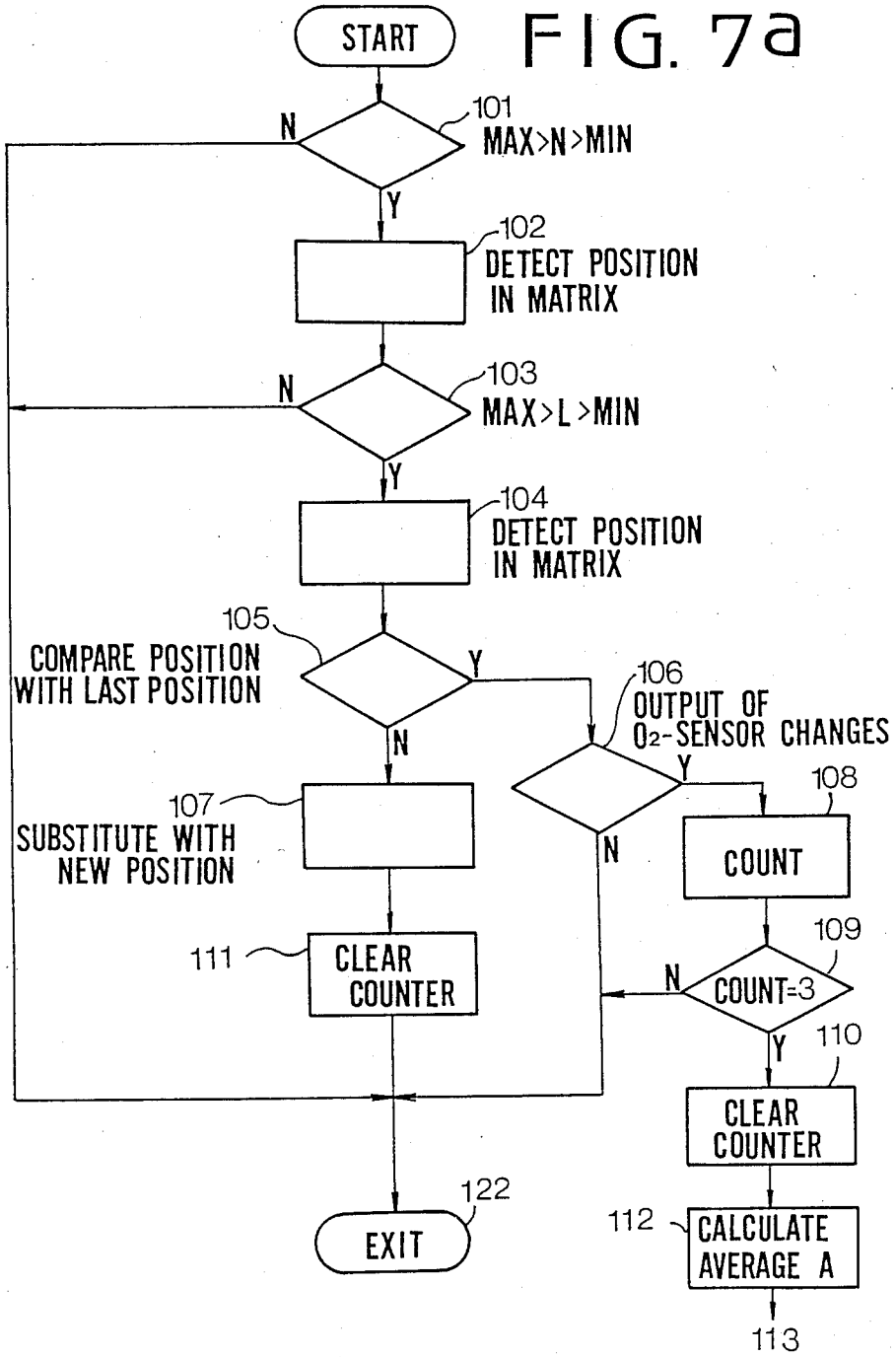
FIG. 7*a* and 7*b* are flowcharts showing the operation in an embodiment of the present invention.
Figure 7B:
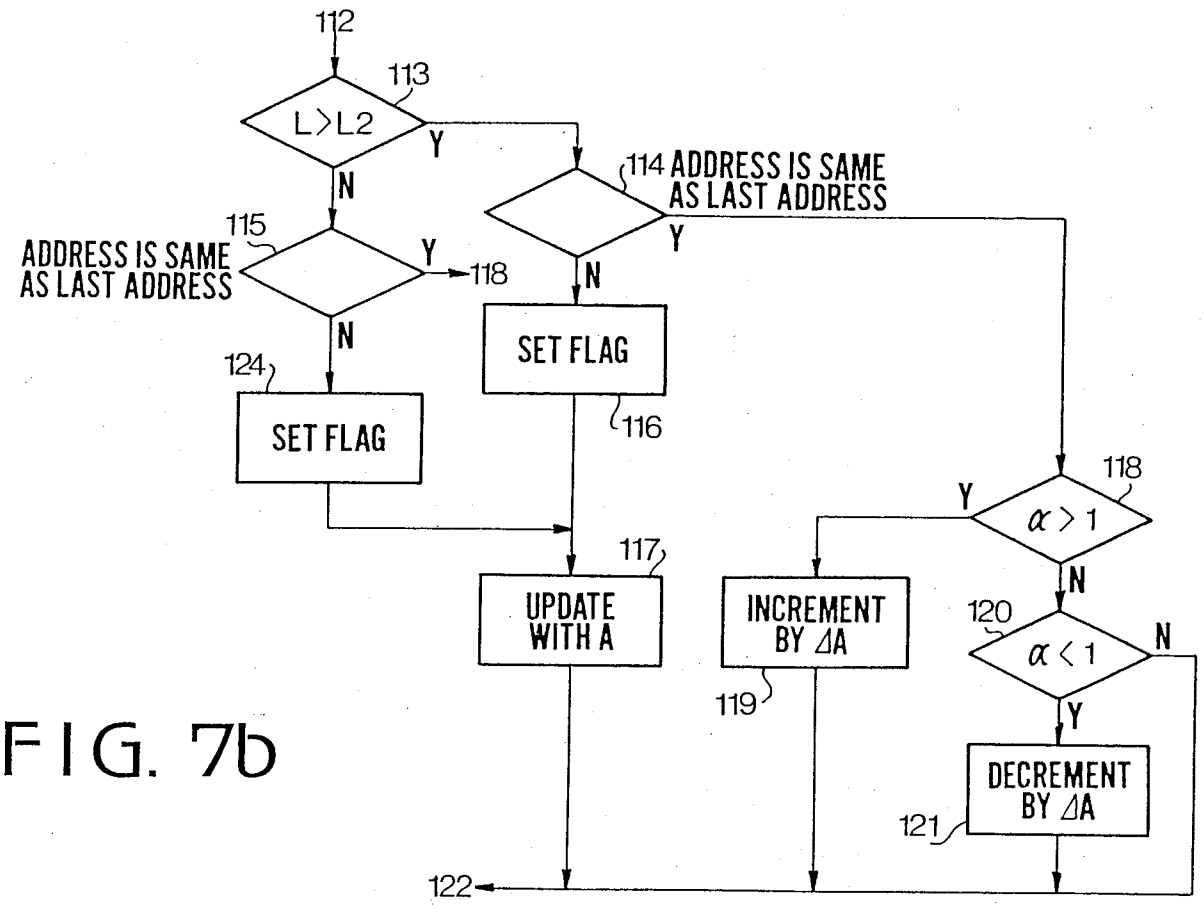

The operation of the system will be described in more detail with reference to FIGS. 7*a* and 7*b*. The learning program is started at a predetermined interval (40 ms). At the first operation of the engine and the first driving of the motor vehicle, engine speed is detected at step 101. If the engine speed is within the range between $N_0$ and $N_5$, the program proceeds to a step 102. If the engine speed is out of the range, the program exits the routine at a step 122. At step 102, the position of the row of the matrix of FIG. 3*a* in which the detected engine speed is included is detected and the position is stored in RAM 30. Thereafter, the program proceeds to a step 103, where engine load is detected. If the engine load is within the range between $L_0$ and $L_5$, the program proceeds to a step 104. If the engine load is out of the range, the program exits from the routine. Thereafter, the position of the column corresponding the detected engine load is detected in the matrix, and the position is stored in the RAM. Thus, the position of the division corresponding to the engine operation condition represented by engine speed and engine load is determined in the matrix, for example, division $D_1$ is decided in FIG. 3*a*. The program advances to a step 105, where the determined position of division is compared with the division which has been detected at the last learning. However, since the learning is first, the comparison can not be performed, and hence the program is terminated passing through steps 107 and 111. At the step 107, the position of division is stored in RAM 30.

At a learning after the first learning, the detected position is compared with the last stored position of division at step 105. If the position of division in the matrix is the same as the last learning, the program proceeds to a step 106, where the output voltage of $O_2$-sensor 16 is detected. If the voltage changes from rich to lean and vice versa, the program goes to a step 108, and if not, the program is terminated. At the step 108, the number of the cycle of the output voltage is counted by a counter. If the counter counts up to, for example three, the program proceeds to a step 110 from a step 109. If the count does not reach three, the program is terminated. At the step 110, the counter is cleared and the program proceeds to a step 112.

On the other hand, if the position of the division is not the same as the last learning at step 105, the program proceeds to step 107, where the old data of the position is substituted with the new data. At the step 111, the counter which has operated at step 108 in the last learning is cleared.

At step 112, the arithmetical average A of the maximum and minimum values of the integral of the output voltage of the $O_2$-sensor at the third cycle or the output waveform is calculated and the value A is stored in a RAM. Thereafter, the program proceeds to a step 113, where it is determined whether the engine load L at which the steady state is detected is greater than the reference value $L_2$. If the load L is greater than the Load $L_2$, the program proceeds to a step 114, and if is not it proceeds to a step 115. At step 114, the address corresponding to the position of the division is detected, for example, the address $a_5$ corresponding to a division $D_2$ is detected. At a step 114 or 115, the detected address is compared with the last stored address Since, before the instant learning, no address is stored, the program proceeds to a step 116 or 124, where the detected address is stored in a RAM to set a flag. At step 117, the learning control coefficient $K_a$ in the address of the $K_a$-table of FIG. 3*b* is entirely updated with the new value A that is the arithmetical average obtained at step 112. A new value A obtained in the division $D_3$ is written in the table $K_a$-1 at the address $a_2$-2.

At a learning after the first updating, if the address detected at the process is the same as the last address, namely, the flag exists in the address, the program proceeds from step 114 or 115 to a step 118, where it is determined whether the value of $\alpha$ (the integral of the output of the $O_2$-sensor) at the learning is greater than "1". If $\alpha$ is greater than "1", the program proceeds to a step 119, where the minimum unit $\Delta A$ (one bit) is added to the learning control coefficient $K_a$ in the corresponding address. If $\alpha$ is less than "1", the program proceeds to a step 120, where it is determined whether $\alpha$ is less than "1". If $\alpha$ is less than "1", the minimum unit $\Delta A$ is subtracted from $K_a$ at a step 121. If $\alpha$ is not less than "1", which means that $\alpha$ is "1", the program exits the updating routine. Thus, the updating operation continues until the value of $\alpha$ becomes "1".

Figure 5:
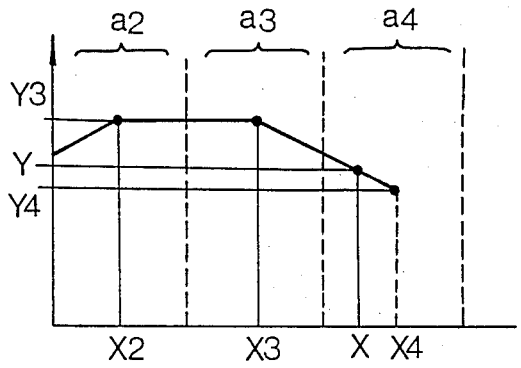
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, values of $K_a$ are stored at intervals of loads. FIG. 5 shows an interpolation of the table $K_a$-2. At engine loads $X_2$, $X_3$, and $X_4$, updated values $Y_3$ and $Y_4$ (as coefficient K) are stored. When detected engine load does not coincide with the set loads $X_2$ to $X_4$, the coefficient $K_a$ is obtained by linear interpolation. For example, value Y of $K_a$ at engine load X is obtained by the following formula.

$$Y=((X-X_3)/(X_4-X_3))\times(Y_4-Y_3)+Y_3$$

Figure 6A:
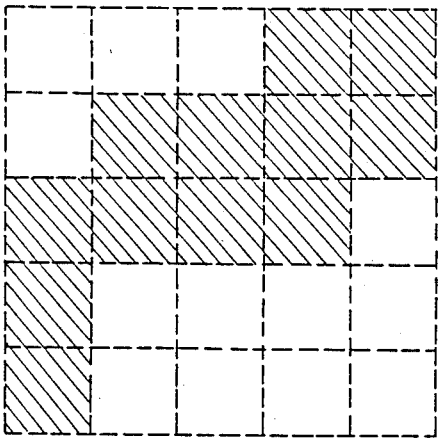
FIGS. 6*a* and 6*b* are illustrations for explaining probability of updating.
Figure 6B:
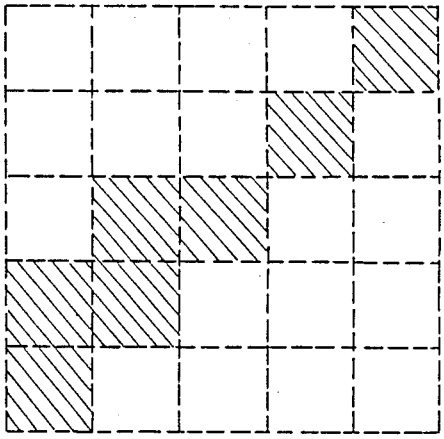

FIG. 6*a* is a matrix pattern showing the updating probability over 50% and FIG. 6*b* is a pattern showing the probability over 70% by hatching divisions in the matrix. More particularly, in the hatched range in FIG. 6*b*, the updating occurs at a probability over 70%. From the figures, it will be seen that the updating probability at the extreme operating steady state, such as the state at low engine load at high engine speed and at high engine load at low engine speed, is very small. In addition, it is experienced that the difference between the value of the coefficient $K_a$ is adjacent speed ranges at high engine load is small. Accordingly, it will be understood that the two-dimensional table for heavy engine load conditions, and the three-dimensional table having a small number of addresses on the other axis for light load conditions are sufficient for performing the learning control of an engine.

Thus, in accordance with the present invention, the system controls engine operation with the data stored in a memory having a small capacity without redcing the operability in a particular engine operting condition, whereby the system can be simplified in construction and reduced in size.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for updating coefficients of data for controlling an automotive engine by the data, comprising:

first means for determining that engine operation is in steady state with respect to first and second variables of engine operation and for producing an output signal when the steady state is determined;

second means for producing new coefficients to be used for updating in the steady state of the engine operation;

means comprising a table storing a plurality of said coefficients, the table comprising:

a two-dimensional table storing said coefficients and having addresses dependent on the first variable; and a three-dimensional table storing said coefficients and having addresses dependent on the first variable and the second variable, the addresses of the three-dimensional table corresponding to a light load operating range of the engine; and third means responsive to the output signal of the first means for updating the coefficients by changing the coefficients stored in respective of the tables at an address corresponding to that at least one of said first and second variables of the first means prevailing in the steady state.

2. The system according to claim 1 further comprising fourth means for detecting one of engine operating conditions and for producing a feedback signal dependent on the condition, the new data for updating being the feedback signal.

3. The system according to claim 1 wherein the first means produces the output signal when engine operating conditions in accordance with the first and second variables continue for a predetermined period of time.

4. A system for updating coefficients of data in an apparatus for controlling air-fuel ratio in an automotive engine by the data, the system comprising:

a two-dimensional table storing a plurality of the coefficients and having addresses dependent on a first variable of engine operation;

a three-dimensional table storing a plurality of the coefficients and having addresses dependent on the first variable and a second variable of engine opertion, all of the addresses of the three-dimensional table corresponding to a light load operating range of the engine, all of the addresses of the two-dimensional table corresponding to an operating range of the engine which is outside said light load operating range;

the apparatus comprising means for detecting an operating condition of the engine and for producing a feedback signal dependent on the latter operating condition;

the apparatus comprising means for controlling the air-fuel ratio dependent on said feedback signal and on currently prevailing of the data in the tables;

the system further comprising:

first means for determining that engine operation is in steady state by determining that said first and second variables of engine operation stay in one of divisions of a matrix for a predetermined period, the matrix being formed by ranges of the first and second variables of engine operation, said second means for producing an output signal when the steady state is so determined;

second means for producing new coefficients to be used for updating the coefficients stored in the tables, in the steady state of the engine operation;

third means for detecting said output signal of the first means for updating the coefficients stored in either the two-dimensional table and the three-dimensional table by replacing the coefficients with the new coefficients at an address of the respective tables corresponding to that of prevailing of the variables of the first means occurring in the steady state, until the feedback signal reaches a desired value.

5. The system according to claim 4, wherein said first variable is engine load and said second variable is engine speed.

6. The system according to claim 5, wherein said addresses of said three-dimensional table corresponding to said second variable correspond to less ranges than the number of the ranges of said second variable of said matrix of said first means.

7. The system according to claim 4, wherein said third means being responsive to the output signal for incrementing and respectively decrementing the coefficients stored in the tables at the respective addresses thereof corresponding to that of the prevailing of the variables of the first means occuring in the steady state.

8. The system according to claim 7, wherein said third means is further responsive to an integral of said feedback signal such that when said integral is greater and smaller than a predetermined value said incrementing and respectively decrementing of said coefficients by a predetermined absolute incremental value occur in the respective of said addresses of the tables, thereby providing said new coefficients in said respective addresses of the tables.

* * * * *